US005447489A

United States Patent [19]

Issalene et al.

[11] Patent Number: 5,447,489

[45] Date of Patent: Sep. 5, 1995

[54] BONE CONDUCTION HEARING AID DEVICE

[76] Inventors: Robert Issalene, 7, rue Ampère, 83100 Toulon; Jean-François Lantrua, "La Campagne" Lot les Grès de Macany, 83400 Hyeres; Bernard Saoli, 7, rue Ampère, 83100 Toulon, all of France

[21] Appl. No.: 217,068

[22] Filed: Mar. 24, 1994

Related U.S. Application Data

[63] Continuation of Ser. No. 834,238, filed as PCT/FR90/00614, Aug. 17, 1990, abandoned.

[30] Foreign Application Priority Data

Aug. 17, 1989 [FR] France ..... 89 10987

[51] Int. Cl.[6] ..... H04K 25/00

[52] U.S. Cl. ..... 600/25; 128/864; 381/68.3

[58] Field of Search ..... 128/859, 860, 864; 600/25; 381/68.3; 433/201.1; 181/127, 128; 379/52

[56] References Cited

U.S. PATENT DOCUMENTS

| | | | |
|---|---|---|---|
| 3,219,033 | 11/1965 | Wallshein | 128/860 |
| 3,277,892 | 10/1966 | Tepper | 128/860 |
| 3,522,805 | 8/1970 | Wallshein | 128/860 |
| 4,606,329 | 8/1986 | Hough | 600/25 |
| 4,612,915 | 9/1986 | Hough | 600/25 |
| 5,052,409 | 10/1991 | Tepper | 128/860 |

FOREIGN PATENT DOCUMENTS 1236782 6/1960 France .

*Primary Examiner*—Michael A. Brown
*Attorney, Agent, or Firm*—Notaro & Michalos

[57] ABSTRACT

This invention provides a hearing aid of the kind which has a transmitter element and a receiver-transducer element having a vibrating element. The receiver element is suitable for being placed, preferably movably, in the mouth of the user. The receiver element includes a device for supporting and holding the vibrating element. The device for supporting and holding the vibrating element is formed so that when the vibrating element is in place it is in permanent contact either with at least one tooth or with the palate bone, thereby providing sound transmission to the inner ear by bone conduction.

17 Claims, 4 Drawing Sheets

Fig. 8
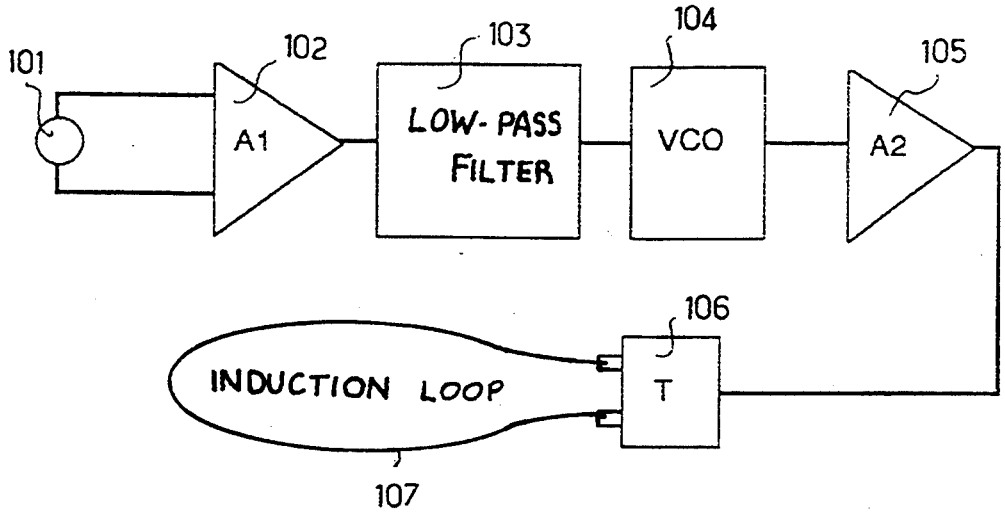
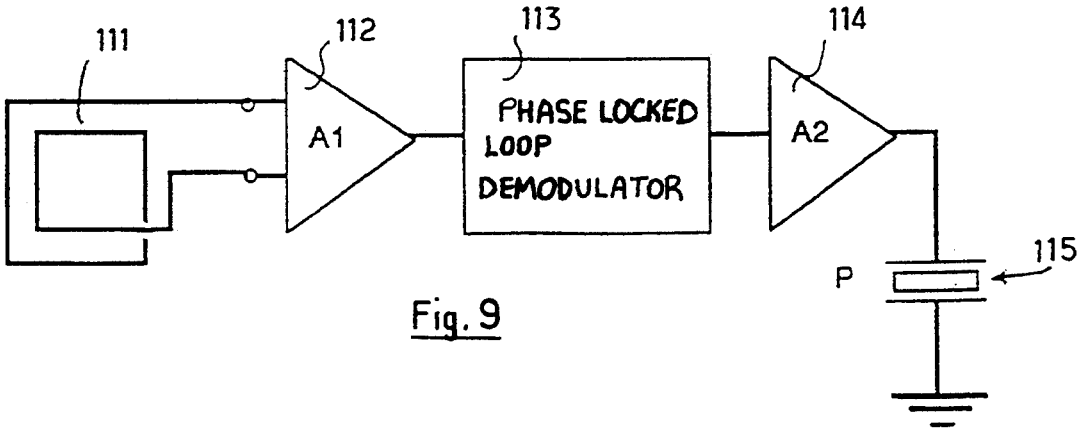
Fig. 9

BONE CONDUCTION HEARING AID DEVICE

This application is a continuation, of application Ser. No. 07/834,238, filed as PCT/FR90/00614, Aug. 17, 1990, now abandoned.

FIELD AND BACKGROUND OF THE INVENTION

The present invention relates generally to a bone conduction hearing aid device.

It is known that the normal perception of sounds results from the transmission of sound waves to an organ called the cochlea situated in the inner ear. More precisely, the acoustic signals or sound waves are picked up by the outer ear, and then transmitted to the middle-ear through the tympanic membrane in order to be perceived by the cochlea which is immobilized in the skull. As a result, a nerve impulse is generated and transmitted to the brain through the auditory nerve.

The more conventional air propagation hearing aid devices work by amplification of the sound signal, notably by means of a loudspeaker placed in the outer ear canal.

Other hearing aid devices, not as well known, are called bone conduction hearing aids and their function is to excite the cochlea by vibrating the skull. Such devices comprise a transmitter part and a receiver transducer part comprising a vibrating element which is placed either against the skin, usually behind the ear, under a certain pressure, or actually in contact with the bone in the mastoid area.

However, said devices have not proven to be satisfactory. Indeed, the apparatuses using a vibrator placed against the skin require strong pressures in order to be efficient (i.e. to transmit the vibrations through the skin) and consequently, they can only be worn for relatively short periods, in order not to cause pain or in some cases, epidermal lesions. What is more, psychologically, the persons on whom they are fitted dislike them on the whole as they are generally visible and inaesthetic.

In addition, the direct bone conduction devices necessitate a surgical operation in order to be fitted. And furthermore, the use of such devices raises a number of serious problems of maintenance such as charging or replacement of the batteries, reaction of the bone subjected to vibrations, adjustment, replacement in case of breakdowns.

SUMMARY OF THE INVENTION

It is therefore the object of the invention to solve the new technical problem consisting in providing a bone conduction hearing device which makes it possible to obtain a sound reception quality comparable to that of the known devices, both without any of the various disadvantages induced by a surgical operation necessary for fitting them permanently.

The solution, according to the invention, for solving said new technical problem consists in a hearing aid device, of the type comprising a transmitter part and a receiver transducer part comprising at least one vibrating element, characterized in that said receiver part is adapted to be fixed, preferably in removable manner, in the mouth of the user, and in that it comprises means for supporting and holding the vibrating element in position, shaped so as to ensure, in the position of use, a permanent contact between said vibrating element and at least one tooth, and/or the palatine bone, thereby ensuring a transmission of the sounds to the inner ear by bone conduction.

According to one particular characteristic of the invention, said vibrating element comprises a metal plate of small thickness coated on one of its faces, preferably with the exception of two lateral strips, with a piezoelectric ceramic, said plate thus coated being contained in an envelope constituted by a film of biocompatible polymer, which is tight and electrically insulating and has an extra thickness at the level of said lateral strips.

According to an advantageous embodiment, the vibrating element further comprises a portion forming a contact block produced preferably in the same material as said envelope, placed substantially in the center of said vibrating element and adapted to come into contact with a tooth while in position of use.

According to a first embodiment, in the case of contact with a tooth, the means supporting and holding the vibrating element in position comprise at least one hook-forming element comprising claws for fastening it to said tooth and to two adjacent teeth and connected to at least one element forming slide guide shaped so as to receive said vibrating element and to hold it in position against the vestibular face of the tooth. According to a particular characteristic, said supporting and holding means are constituted of two hook-forming elements placed on either side of the tooth, each hook-forming element being connected to an element forming a slide guide, said elements forming the slide guide being interconnected by a rigid bar.

Advantageously, the two elements forming the slide guide have a substantially U-shaped cross-section and ensure, by their part forming the base of the U, the connection with said hook-forming elements.

According to a second embodiment of the invention, in the case of contact with the palatine bone, the means supporting and holding the vibrating element in position are constituted by a palatine plate, optionally the palatine plate of a partial or total dental prosthesis, preferably produced in an acrylic resin and comprising a recess shaped so as to receive said vibrating element and to hold it against the palatine bone.

According to another characteristic of the invention, the receiver part also includes a miniaturized unit comprising a receiver, an amplifier and batteries preferably rechargeable by inductive coupling, said elements being connected together and to said vibrating elements by means of flexible connectors.

Advantageously, in the case of contact with a tooth, the receiver, the amplifier and optionally the batteries are contained in an envelope produced in polymer resin, shaped so as to adapt, in the case of contact with a tooth, to the available vestibular space.

BRIEF DESCRIPTION OF THE DRAWINGS

The invention will be more readily understood and other objects, characteristics and advantages thereof will become clearer on reading the following detailed description, given with reference to the appended diagrammatical drawings given solely by way of non-restrictive examples, illustrating several currently preferred embodiments of the invention, and in which:

FIGS. 8 and 9 are block diagrams of one embodiment of the transmitter and receiver part of a hearing aid device according to the invention.

DESCRIPTION OF THE PREFERRED EMBODIMENTS

In general, a hearing aid device according to the invention is constituted of two separate parts, namely an extrabuccal transmitter part and an intrabuccal receiver transducer part.

The transmitter part is constituted, in manner known per se, by a microphone connected to the input of a correcting amplifier modulating a conventional sytem of wireless transmission. Said part can be produced in compact form and can be supplied by batteries.

The receiver part is constituted by a miniaturized unit comprising a receiver, an amplifier and a vibrating element, these various elements being advantageously connected together by flexible electrical conductors, thereby allowing a great adaptability to the anatomical peculiarities of the mouth of every person to be equipped.

Figure 1:
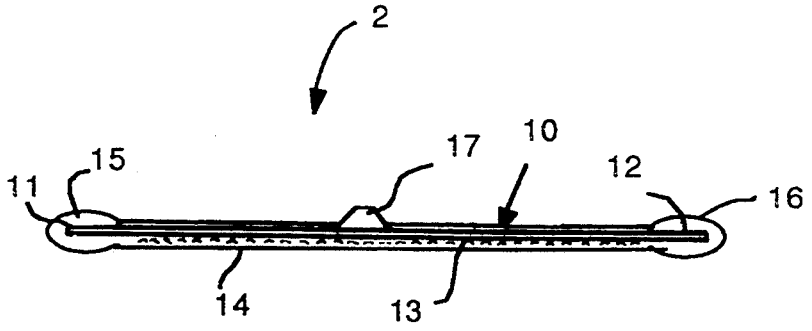
FIG. 1 is a cross-sectional view of a vibrating element of a hearing aid device according to the invention, in the case of contact with a tooth.

FIG. 1 illustrates a cross-sectional view of a vibrating element (vibration generator or vibrator) of a hearing aid device according to the invention, in case of contact with a tooth.

Said vibrating element 2 is constituted by a metal plate 10, substantially rectangular and of small thickness, coated on one of its faces with a piezoelectric ceramic 13; said plate, thus coated, being contained in an envelope 14 constituted by a film of biocompatible polymer, which is tight and electrically insulating, such as for example a film of acrylic resin.

The vibrating element further comprises electrical connections, not shown, preferably embedded in the polymer film constituting the envelope.

Advantageously, the layer of piezoelectric ceramic 13 will cover the whole surface of one of the faces of the metal plate 10, with the exception of two lateral strips 11, 12 in order to increase the amplitude gradient between the center of the plate 13 and its two lateral edges.

In the illustrated example, the polymer film constituting the envelope 14 presents an extra thickness 15, 16 at the level of the lateral strips 11, 12 for reasons to be explained hereinafter.

According to a particularly advantageous embodiment, the vibrating element 2 further comprises a portion 17 forming contact block, which portion is substantially truncated and situated preferably in the center of the vibrating element 2 and designed to come into contact with the tooth, while in the position of use. Said contact block 17 is preferably produced in the same material as the envelope 14 and can be added thereon or produced therewith.

Figure 2:
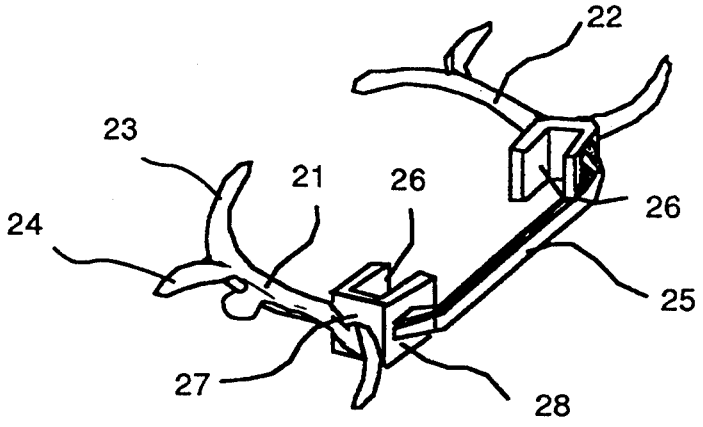
FIG. 2 is a perspective view illustrating the means supporting and holding the vibrating element in position illustrated in FIG. 1.

FIG. 2 is a perspective view illustrating the means supporting and holding in position the vibrating element illustrated in FIG. 1.

Figure 3:
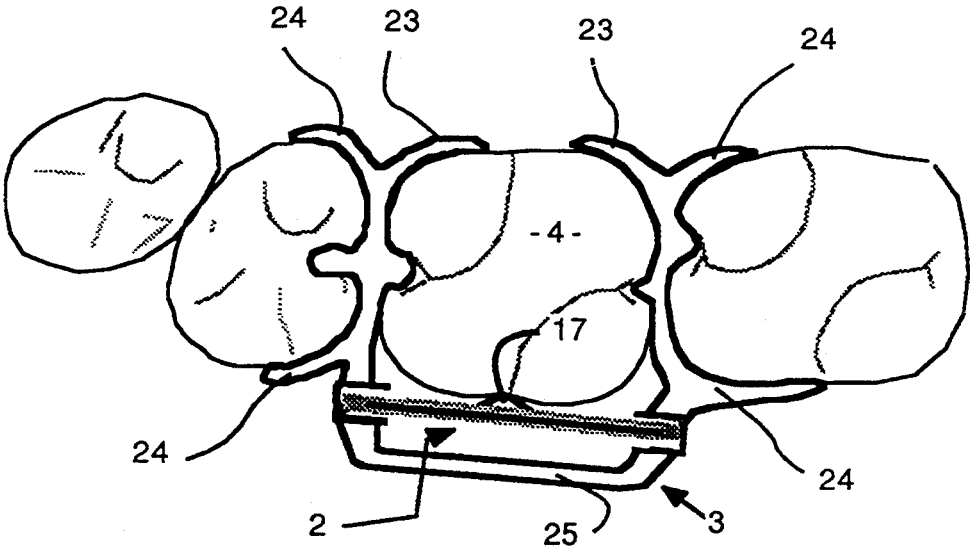
FIG. 3 is a diagrammatical plan view illustrating the operation of placing the vibrating element shown in FIG. 1 in contact with a tooth.

Said means comprise two hook-forming elements 21, 22, designed to be placed, while in position of use, on either side of a tooth 4 (see FIG. 3); each element 21, 22 being connected to an element forming slide guide 26, said elements forming slide guide being interconnected by a rigid bar 25. Said bar can be placed, while in the position of use, close to the vestibular face of the tooth 4, as in the illustrated example, and prevents strong mechanical stresses (such as twisting or bending) from being exerted on the vibrating element.

The hook-forming elements 21, 22 can be produced in chromium-nickel and ensure fastening of the vibrating element on the tooth. To this effect, said elements comprise claws 23 fastenable to the tooth 4 and 24 fastenable to the adjacent teeth.

Said elements can be produced, by taking an impression of the tooth 4 and of the adjacent teeth, so as to ensure efficient fastening.

The two elements forming slide guide 26, which are placed at each end of the bar 25 are designed to receive the lateral edges of the vibrating element 2 and to keep it in position against the vestibular face of the tooth 4. The extra thicknesses 15, 16 of the envelope 14 of the vibrating element 2 are advantageously shaped so as to be in conformity with the inner dimensions of the elements forming slide guide 26 which have a substantially U-shaped cross-section, and to hold the vibrating element in position in the slide guides, without any risks of twisting or bending.

The elements forming slide guide 26 also ensure the connection of the hook-forming elements 21, 22 to the rigid bar 25. To this effect, the hook-forming elements 21, 22 are fixed, for example by soldering, to the base-forming part 27 of the elements forming slide guide 26, while the bar 25 is fixed on the adjacent face 28 of said element.

Figure 4:
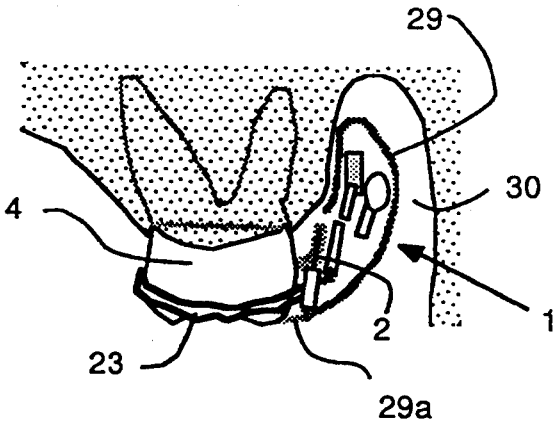
FIG. 4 is a diagrammatical view showing the receiver part of a hearing aid device according to a first embodiment of the invention, in the case of contact with a tooth.

The receiver part generally designated by reference numeral 1 in FIG. 4 further includes a miniaturized unit comprising a receiver, an amplifier and batteries. Advantageously, the receiver, the amplifier and optionally also the batteries are contained in an envelope produced in a polymer resin, such as for example an acrylic resin, in foam form, shaped so as to adapt to the available vestibular space 30. Advantageously, the envelope 29 is provided with a sealing strip 29*a* ensuring close contact, on the vestibular face of the tooth, close to the free edge of the latter. Said strip, which conceals the vibrating element 2, prevents foodstuffs from accumulating in the space existing between the vibrating element and the tooth, during mastication.

Figure 5:
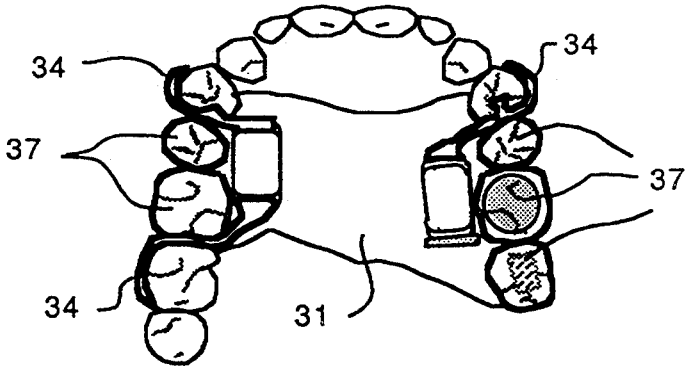
FIG. 5 is a diagrammatical view illustrating the receiver part of a hearing aid device according to a second embodiment of the invention, in the case of contact with the palatine bone.
Figure 6:
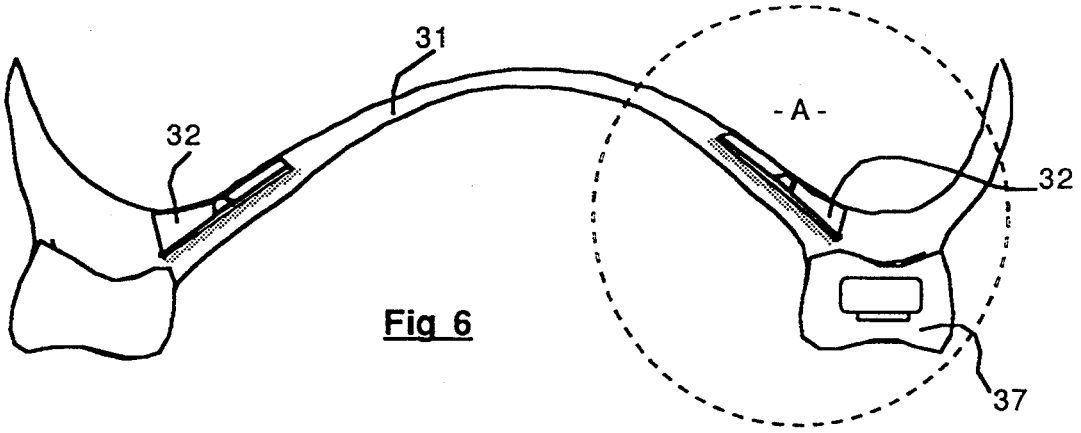
FIG. 6 is a cross-sectional view of the device illustrated in FIG. 5.

FIG. 5 illustrates a second embodiment of the receiver part of a hearing aid device according to the invention, in the case of contact with the palatine bone. The teeth may be all natural teeth, or some may be natural and others artificial. In the illustrated example, the teeth 37 are artificial, the three visible hooks resting against natural teeth. FIG. 6 is a cross-sectional view of FIG. 5 where the teeth are artificial, while FIG. 7 is an enlarged view of the detail A in FIG. 6.

This second embodiment finds a particular application in the case where the patient to be equipped has an incomplete dentition (partial loss of teeth). It is to be noted that, under this assumption, both the conduction through the palatine bone and the conduction through the teeth are used.

Figure 7:
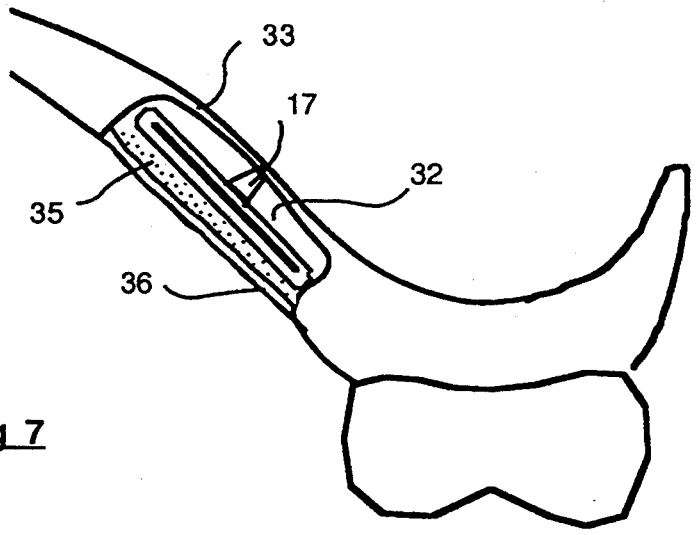
FIG. 7 is an enlarged view of the detail A in FIG. 6 showing the vibrating element used in said second embodiment of the invention.

It is understood that FIGS. 6 and 7 can also represent a cross-sectional view of a total prosthesis in the case of a total loss of teeth. In this case, the means supporting and holding the vibrating element in position are formed by the palatine plate and the conduction occurs only through the palatine bone.

In the present description and claims, contact with the palatine bone designates the close contact of the intrados of the palatine plate (which may be the palatine plate of a total prosthesis) with the fibromucous membrane covering the palatine bone via the salivary film. This film contributes to conduction of the vibrations and constitutes a conduction medium considerably superior to air.

In this particular embodiment, the vibrating element 2 has a general structure identical to that described hereinabove with reference to FIG. 1.

In this case, the means supporting and holding the vibrating element in position are constituted by a palatine plate 31, preferably produced in an acrylic resin and comprising a recess 32 designed to receive the vibrating element 2 and to hold it in position against the palatine bone. The dimensions of the recess 32 are such that the portion forming contact block 17 exerts a pressure in the center of the wall 33 of small thickness, forming the base of the recess 32 in contact with the palatine bone.

The palatine plate 31 may be that of a partial or total dental prosthesis of the "adjoined" type, namely mobile. It is understood that this is one novelty of the the invention which, in the case of a partial or total loss of teeth, provides a bi-functional device acting both as a dental prosthesis and as an auditory prosthesis, each one of which two functions not in any way impeding the other.

Such a device is fitted in as follows:

First of all a palatine plate adapted to the shape of the patient's palate is prepared.

On said plate is provided an open recess whose dimensions are slightly greater than those of a vibrating element 2.

A vibrating element 2 on the lateral edges of which are placed fastening hooks 34 is introduced into the recess 32 in such a way that the vibrator comes into contact with the wall 33 forming the base of the recess.

Once the vibrating element has been placed in its recess, it is coated with a thin layer of plastic foam 35, and then with a layer of acrylic resin 36, closing tightly the recess 32.

The batteries, the amplifier and the receiver can be placed inside artificial teeth 37, in the case of a partial loss of teeth.

The elements constituting the transmitter part (FIG. 8) and the receiver part (FIG. 9) of a hearing aid device according to the invention have been illustrated diagrammatically as examples of embodiment.

The transmitter part comprises the following elements connected in series: a sensitive microphone 101, an amplifier 102, a low-pass filter 103, a voltage-controlled oscillator 104, a second amplifier 105, a transformer 106 and an induction loop 107.

Said transmitter part works as follows:

The signal is picked up by the microphone 101, amplified by the amplifier 102 then limited in its passband by means of the filter 103 (filter 6 dB at 4.5 kHz; 70 dB min between 6.5 kHz and 50 kHz); a carrier substantially equal to the free frequency of the oscillator 104 is thus modulated by the output of the filter 103 which acts on the voltage-control input of the oscillator 104, then the modulated signal is transmitted to the transformer 106 via amplifier 105, in order to attack the induction loop 107.

The receiver part also comprises the following elements: a coil 111, an amplifier 112, a demodulator (phase lock loop) 113, an amplifier 114 and the piezoelectric resonator 115.

Said receiver part works as follows:

The signal is detected by the coil 111, it is amplified by amplifier 112, the phase lock demodulator 113 detects the carrier at 24 kHz, locks on and retrieves the signal which is thereafter amplified by amplifier 114 to attack the piezoelectric resonator 115.

The hearing aid device described hereinabove presents many advantages.

It makes it possible to obtain a very good sound reception, comparable to that of the known devices.

It is easily fitted in without any surgical intervention, and easy to maintain.

It is discreet because invisible on the outside.

It can be bi-functional because of being readily integrated in a dental prosthesis in the case of partial or total loss of teeth of the person to be equipped.

It does not interfere with the natural functions of the mouth (mastication, . . . ).

We claim:

1. Hearing aid device comprising:

an extra-buccal wireless transmitter part;

an intra-buccal wireless receiver transducer part for receiving signals from the transmitter part and comprising at least one vibrating element, said receiver part (1) being adapted to be fixed, in a removable manner, in the mouth of the user, and comprising means (3) for supporting and holding the vibrating element (2) in position, shaped so as to ensure, in a position of use, a permanent contact between said vibrating element and at least one of a tooth (4), and a palatine bone, thereby ensuring a transmission of sounds received as signals from the transmitter part, to the inner ear, exclusively by bone conduction, said vibrating element (2) being sealed and electrically insulated from the at least one of the tooth (4) and palatine bone.

2. Hearing aid device according to claim 1, wherein in that in the case of contact with a tooth, said means (3) for supporting and holding the vibrating element (2) in position comprise at least one hook-forming element comprising claws (23) for fastening it to said tooth and (24) for fastening it to two adjacent teeth and connected to at least one element forming slide guide shaped so as to receive said vibrating element (2) and to hold it in position against the vestibular face of the tooth (4).

3. Hearing aid device according to claim 2, wherein said supporting and holding means are constituted of two hook-forming elements (21, 22) placed on either side of the tooth (4), each hook-forming element being connected to an element (28) forming slide guide, said elements forming slide guide being interconnected by a rigid bar (25).

4. Hearing aid device according to claim 3, wherein the two elements (26) forming slide guide have a substantially U-shaped cross-section and ensure, by their part forming the base (27) of the U, the connection with said hook-forming elements (21,22).

5. Hearing aid device according to claim 1, wherein in that in the case of contact with the palatine bone, the means supporting and holding the vibrating element in position are constituted by a palatine plate (31), produced in an acrylic resin and comprising a recess (32) shaped so as to receive said vibrating element (2) and to hold it in position against the palatine bone.

6. Hearing aid device according to claim 1, wherein in that the receiver part (1) further includes a miniaturized unit comprising a receiver, an amplifier and batteries rechargeable by inductive coupling, said elements being connected together and to said vibrating elements by means of flexible connectors.

7. Hearing aid device according to claim 6, characterized in that the receiver, the amplifier and are contained in an envelope produced in polymer resin, shaped so as to adapt, in the case of contact with a tooth, to available vestibular space.

8. Hearing aid device of the type comprising an extra-buccal transmitter part and an intra-buccal receiver transducer part comprising at least one vibrating element, wherein said receiver part (1) is adapted to be fixed, in a removable manner, in the mouth of the user, and it comprises means (3) for supporting and holding the vibrating element (2) in position, shaped so as to ensure, in the position of use, a permanent contact between said vibrating element and at least one of a tooth (4), and a palatine bone, thereby ensuring a transmission of the sounds to the inner ear by bone conduction, and said vibrating element (2) being sealed and electrically insulated, said vibrating element (2) comprising a metal plate (10) of small thickness coated on one side of its faces with a piezoelectric ceramic (13), said plate thus coated being contained in an envelope (14) constituted by a film of biocompatible polymer.

9. Hearing aid device according to claim 8, wherein the vibrating element (2) further comprises a portion (17) forming contact block produced in the same material as said envelope (14), placed substantially in the center of said vibrating element (2) and adapted to come into contact with a tooth (4) while in position of use.

10. Hearing aid device according to claim 8, wherein, in the case of contact with a tooth, the means (3) for supporting and holding the vibrating element (2) in position comprises at least one hook-forming element comprising claws (23) for fastening to the tooth.

11. Hearing aid device according to claim 10, wherein said claws are shaped for fastening between two adjacent teeth, and a slide guide shaped element connected to the claws, the slide guide shaped element being shaped for receiving said vibrating element in a position for holding said vibrating element against a face of the tooth.

12. Hearing aid device according to claim 8, wherein the means (3) for supporting and holding the vibrating element (2) comprises two spaced apart hook-forming elements for engaging a tooth, a slide guide element connected to each hook-forming element, said vibrating element being slidably engaged between said slide guide elements, and a rigid element (25) connected between the slide guide elements.

13. Hearing aid device according to claim 12, wherein each slide guide element is substantially U-shaped.

14. Hearing aid device according to claim 13, wherein each U-shaped slide guide element has a base connected to a respective one of said hook-forming elements.

15. Hearing aid device according to claim 8, wherein in the case of contact with a palatine bone, the means (3) for supporting and holding the vibrating element (2) in position, comprises a palatine plate of a dental prosthesis having a recess for receiving said vibrating element and holding it against the palatine bone.

16. Hearing aid device according to claim 8, including a rechargeable battery and means for recharging the battery by inductive coupling, connected to the receiver transducer part.

17. Hearing aid device according to claim 16, wherein the receiver transducer part includes a miniaturized unit with a receiver and an amplifier connected to the battery, and a polymer envelope containing the receiver, amplifier and battery shaped to be received in a vestibular space adjacent a tooth.

* * * * *